US006677700B2

(12) United States Patent
Benigni et al.

(10) Patent No.: US 6,677,700 B2
(45) **Date of Patent: *Jan. 13, 2004**

(54) CATHODE-RAY TUBE HAVING A FOCUS MASK USING PARTIALLY CONDUCTIVE INSULATORS

(75) Inventors: Samuel Paul Benigni, Lititz, PA (US); Wilber Clarence Stewart, Hightstown, NJ (US); Philip Michael Heyman, West Windsor, NJ (US); Richard William Nosker, Princeton, NJ (US)

(73) Assignee: Thomson Licensing S. A., Boulogne Cedex (FR)

( * ) Notice: Subject to any disclaimer, the term of this patent is extended or adjusted under 35 U.S.C. 154(b) by 200 days.

This patent is subject to a terminal disclaimer.

(21) Appl. No.: 09/746,242

(22) Filed: Dec. 22, 2000

(65) Prior Publication Data

US 2002/0079804 A1 Jun. 27, 2002

(51) Int. Cl.[7] ..... H01J 29/80
(52) U.S. Cl. ..... 313/402; 313/403; 313/407
(58) Field of Search ..... 313/402, 403, 313/404, 405, 406, 407

(56) References Cited

U.S. PATENT DOCUMENTS 5,646,478 A * 7/1997 Nosker et al. ..... 313/402
5,647,653 A * 7/1997 Cherukuri ..... 313/402
2002/0074923 A1 * 6/2002 Sreeram et al. ..... 313/402
2002/0074924 A1 * 6/2002 Cohee et al. ..... 313/402
2002/0079811 A1 * 6/2002 Thaler et al. ..... 313/407

* cited by examiner

*Primary Examiner*—Nimeshkumar D. Patel
*Assistant Examiner*—Elizabeth Gemmell
(74) *Attorney, Agent, or Firm*—Joseph S. Tripoli; Carlos M. Herrera; Patricia A. Verlangieri

(57) ABSTRACT

A color cathode-ray tube has an evacuated envelope with an electron gun therein for generating an electron beam. The envelope further includes a faceplate panel having a luminescent screen with phosphor elements on an interior surface thereof. A focus mask, having a plurality of spaced-apart first conductive strands, is located adjacent to an effective picture area of the screen. The spacing between the first conductive strands defines a plurality of apertures substantially parallel to the phosphor elements on the screen. Each of the first conductive strands has a substantially continuous insulating material layer formed on a screen-facing side thereof. A plurality of second conductive wires are oriented substantially perpendicular to the plurality of first conductive strands and are bonded thereto by the insulating material layer. The insulating material layer is partially or slightly conductive to an extent sufficient to prevent an accumulation of a significant electrical charge.

6 Claims, 4 Drawing Sheets

CATHODE-RAY TUBE HAVING A FOCUS MASK USING PARTIALLY CONDUCTIVE INSULATORS

BACKGROUND OF THE INVENTION a. Field of the Invention

This invention relates to a color cathode-ray tube (CRT) and, more particularly to a color CRT having a focus mask.

b. Description of the Background

A color cathode-ray tube (CRT) typically includes an electron gun, an aperture mask, and a screen. The aperture mask is interposed between the electron gun and the screen. The screen is located on an inner surface of a faceplate of the CRT tube. The screen has an array of three different color emitting phosphors (e.g., green, blue, red) formed thereon. The aperture mask functions to direct electron beams generated in the electron gun toward appropriate color emitting phosphors on the screen of the CRT tube.

The aperture mask may be a focus mask. Color CRT focus mask designs fundamentally incorporate at least two metallic electrodes separated by a suitable electrically insulating material and arranged in such a way as to create a periodic configuration of apertures through which electron beams pass on their way to the phosphor screen. When a suitable bias voltage is applied to the metallic electrodes, electric fields are generated at each of the mask apertures to form an electron optical lens, which provides the desired focussing of the electron beams upon the phosphor screen.

One type of focus mask is a tensioned focus mask, wherein at least one of the sets of metallic electrodes is under tension. Typically, for a tensioned focus mask, the vertical set of metallic electrodes is under tension, with the horizontal set of metallic electrodes overlying such vertically tensioned electrodes.

Where the two sets of metallic electrodes overlap, such electrodes are typically attached at their crossing points (junctions) by an insulating material. When a voltages is applied between the two sets of metallic electrodes of the mask, to create multipole focusing lenses in the openings thereof, high voltage (HV) flashover may occur. HV flashover is the dissipation of an electrical charge across the insulating material separating the two sets of conductive lines. HV flashover is undesirable because it may cause an electrical short circuit between the two sets of conductive electrodes leading to the subsequent failure of the focus mask.

Additionally, when the electron beams from the electron gun are directed toward the color emitting phosphors on the screen, redirected electrons (back-scattered electrons) from the phosphor screen may impinge upon the surface of the insulator material, causing it to become electrically charged. This surface charging modifies the desired potential field at the mask apertures and may impair the image quality displayed by the phosphor screen.

Thus, a need exists for an insulator material suitable for CRT focus masks that overcomes the above-mentioned drawbacks.

SUMMARY OF THE INVENTION

The present invention relates to a color cathode-ray tube having an evacuated envelope with an electron gun therein for generating an electron beam. The envelope further includes a faceplate panel having a luminescent screen with phosphor elements on an interior surface thereof. A focus mask, having a plurality of spaced-apart electrodes, is located adjacent to an effective picture area of the screen. The spacing between the first conductive metallic strands defines a plurality of apertures substantially parallel to the phosphor elements on the screen. Each of the first conductive strands has a substantially continuous insulating material layer formed on a screen-facing side thereof. A plurality of second conductive wires is oriented substantially perpendicular to the plurality of first conductive strands and are bonded thereto by the insulating material layer. The insulating material layer is partially or slightly conductive to an extent sufficient to prevent an accumulation of a significant electrical charge.

BRIEF DESCRIPTION OF THE DRAWING

The invention will now be described in greater detail, with relation to the accompanying drawing, in which.

DETAILED DESCRIPTION OF THE PREFERRED EMBODIMENT

Figure 1:
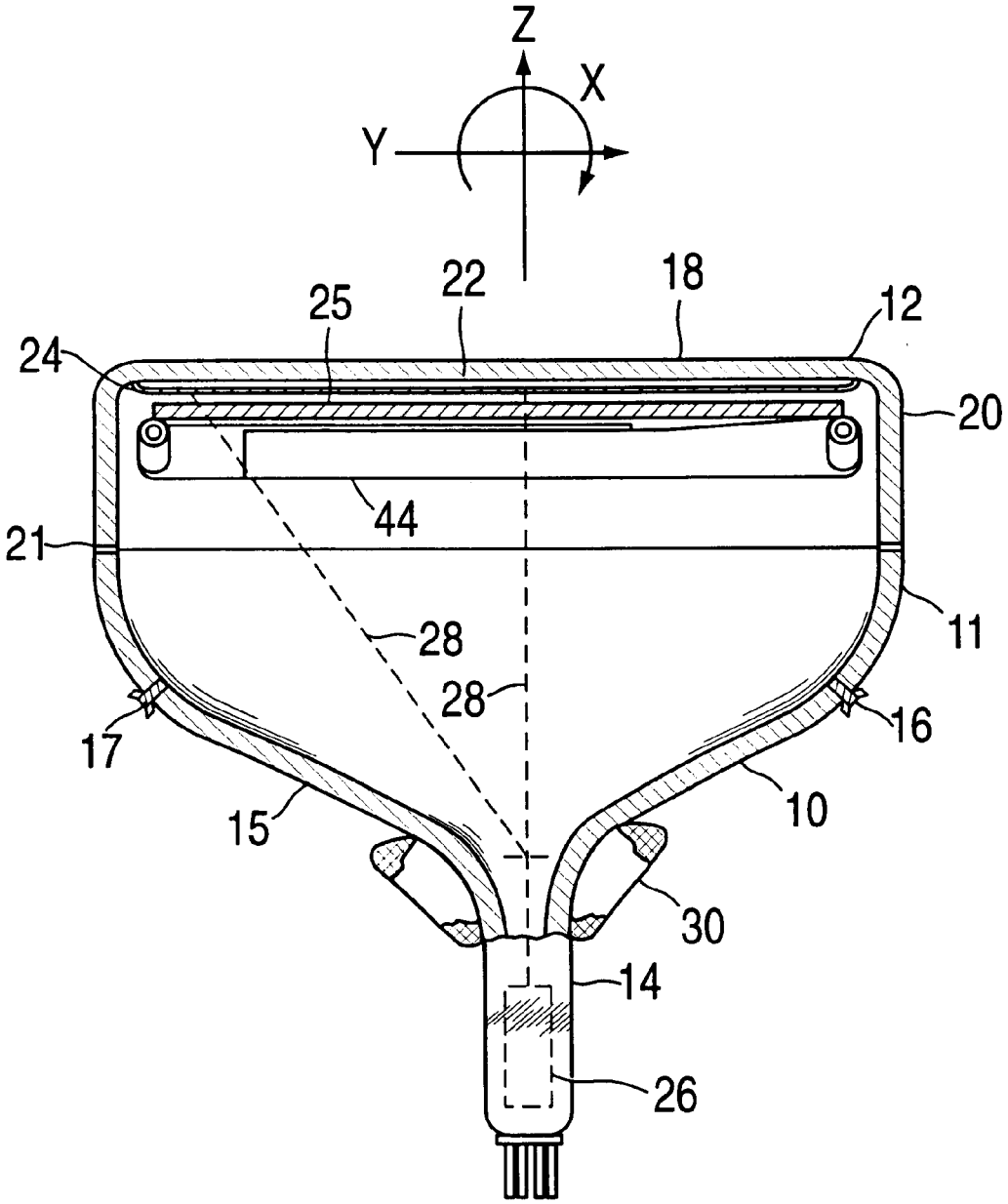
FIG. 1 is a plan view, partly in axial section, of a color cathode-ray tube (CRT) including a focus mask-frame assembly embodying the present invention.

FIG. 1 shows a color cathode-ray tube (CRT) 10 having a glass envelope 11 comprising a rectangular faceplate panel 12 and a tubular neck 14 connected by a rectangular funnel 15. The funnel has an internal conductive coating (not shown) that is in contact with, and extends from, a first anode button 16 to the neck 14. A second anode button 17, located opposite the first anode button 16, is not contacted by the conductive coating.

The panel 12 comprises a cylindrical viewing faceplate 18 and a peripheral flange or sidewall 20 that is sealed to the funnel 15 by a glass frit 21. A three-color luminescent phosphor screen 22 is coated on the inner surface of the faceplate 18. The screen 22 is a line screen, shown in detail in FIG. 5, that includes a multiplicity of screen elements comprised of red-emitting, green-emitting, and blue-emitting phosphor elements, R, G, and B, respectively, arranged in triads, each triad including a phosphor of each of the three colors. Preferably, a light absorbing matrix 23 separates the phosphor elements. A thin conductive layer 24, preferably of aluminum, overlies the screen 22 and provides means for applying a uniform first anode potential to the screen, as well as for reflecting light emitted from the phosphor elements through the faceplate 18.

A cylindrical multi-aperture color selection electrode, or focus mask 25, is mounted, by conventional means, within the panel 12, in predetermined spaced relation to the screen 22. An electron gun 26, shown schematically by the dashed lines in FIG. 1, is centrally mounted within the neck 14 to generate and direct three inline electron beams 28, a center and two side or outer beams, along convergent paths through the mask 25 to the screen 22. The inline direction of the beams 28 is normal to the plane of the paper.

The CRT of FIG. 1 is designed to be used with an external magnetic deflection yoke, such as yoke 30, shown in the neighborhood of the funnel-to-neck junction. When activated, the yoke 30 subjects the three electron beams to magnetic fields that cause the beams to scan a horizontal and vertical rectangular raster over the screen 22. The mask 25 is formed, preferably, from a thin rectangular sheet of about 0.05 mm (2 mil) thick low carbon steel (about 0.005% carbon by weight). Suitable materials for the mask 25 may include high expansion, low carbon steels having a coefficient of thermal expansion (COE) within a range of about $120–160\times10^{-7}/°$ C.; intermediate expansion alloys such as, iron-cobalt-nickel (e. g., KOVAR™) having a coefficient of thermal expansion within a range of about $40–60\times10^{-7}/°$ C.; as well as low expansion alloys such as iron-nickel (e.g., INVAR™) having a coefficient of thermal expansion within a range of about $15–30\times10^{-7}/°$ C.

Figure 2:
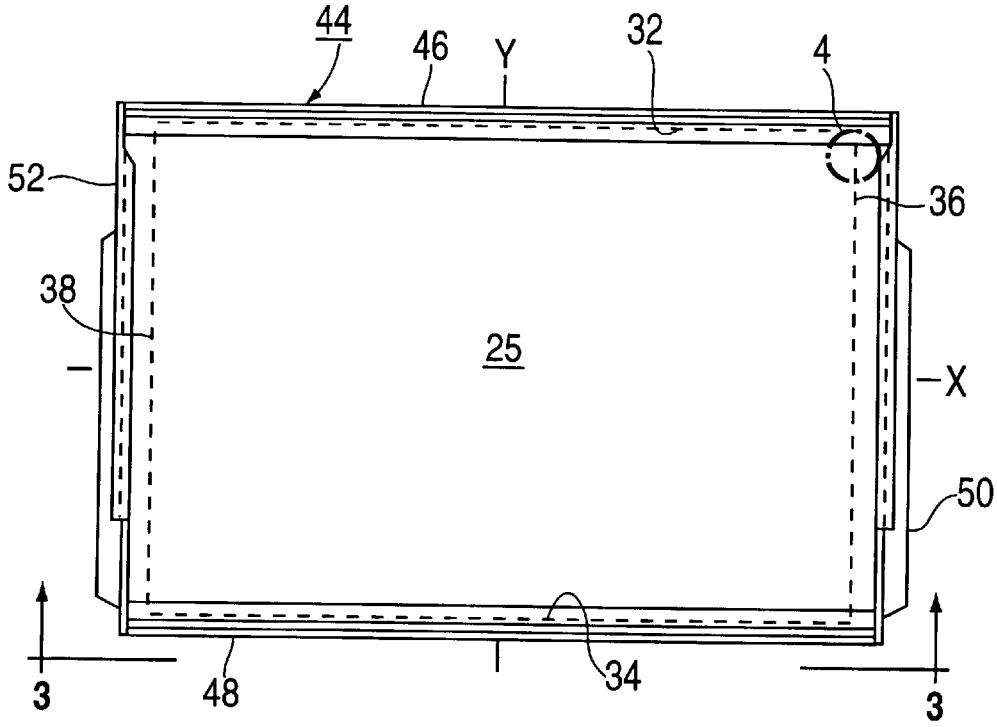
FIG. 2 is a plan view of the focus mask-frame assembly of FIG. 1.

As shown in FIG. 2, the mask 25 includes two long sides 32, 34 and two short sides 36, 38. The two long sides 32, 34 of the mask 25 are parallel with the central major axis, X, of the CRT while the two short sides 36, 38 are parallel with the central minor axis, Y, of the CRT.

Figure 4:
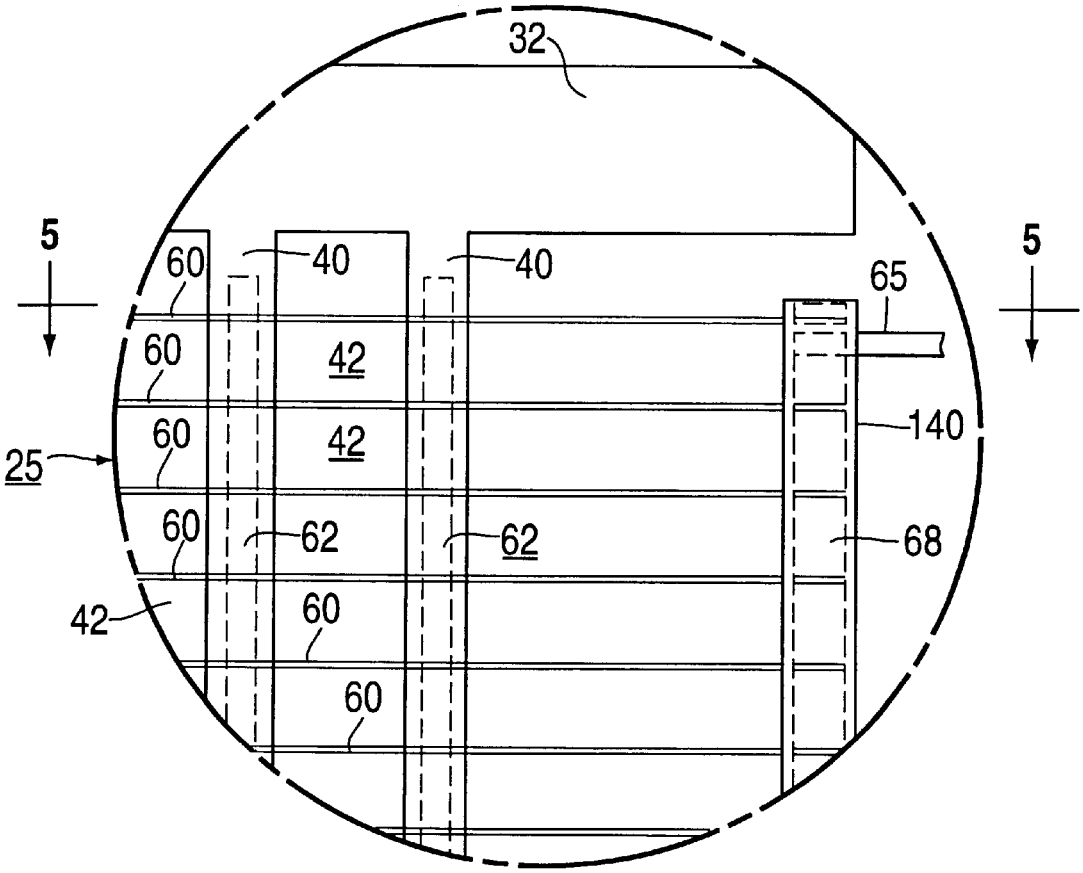
FIG. 4 is an enlarged section of the focus mask shown within the circle 4 of FIG. 2.

Mask 25 includes an aperture portion that is adjacent to and overlies an effective picture area of the screen 22, which lies within the central dashed lines of FIG. 2 that define the perimeter of the mask 25. As shown in FIG. 4, the focus mask 25 includes a plurality of first conductive metal strands 40, each having a transverse dimension, or width, of about 0.3 mm (12 mils) separated by substantially equally spaced apertures 42, each having a width of about 0.55 mm (21.5 mils) that parallel the minor axis, Y, of the CRT and the phosphor elements of the screen 22. In a color CRT having a diagonal dimension of 68 cm (27 V), there are about 600 of the first metal strands 40. Each of the apertures 42 extends from one long side 32 of the mask to the other long side 34 thereof (not shown in FIG. 4).

Figure 3:
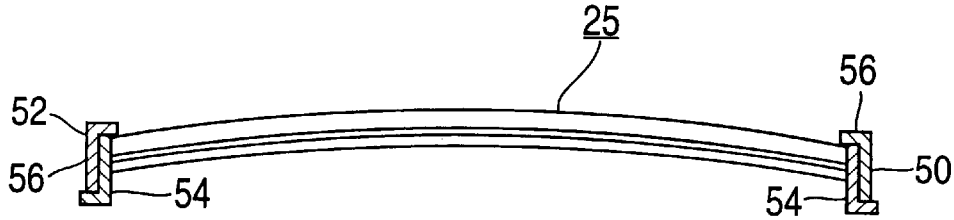
FIG. 3 is a front view of the mask-frame assembly taken along line 3—3 of FIG. 2.

A frame 44, for the mask 25, is shown in FIGS. 1–3, and includes four major members, two torsion tubes or curved members 46, 48 and two tension arms or straight members 50, 52. The two curved members 46, 48 are parallel to the major axis, X, and each other. As shown in FIG. 3, each of the straight members 50, 52 includes two overlapped partial members or parts 54, 56, each part having an L-shaped cross-section. The overlapped parts 54, 56 are welded together where they are overlapped. An end of each of the parts 54, 56 is attached to an end of one of the curved members 46, 48. The curvature of the curved members 46, 48 matches the cylindrical curvature of the focus mask 25. The long sides 32, 34 of the focus mask 25 are welded between the two curved members 46, 48, which provides tension to the mask. Before welding the long sides 32, 34 of the mask to the frame 44, the mask material is pre-stressed and darkened by tensioning the mask material while heating it, in a controlled atmosphere of nitrogen and oxygen, at a temperature of about 500° C., for about one hour. The frame 44 and the mask material, when welded together, comprise a tension mask assembly.

Figure 5:
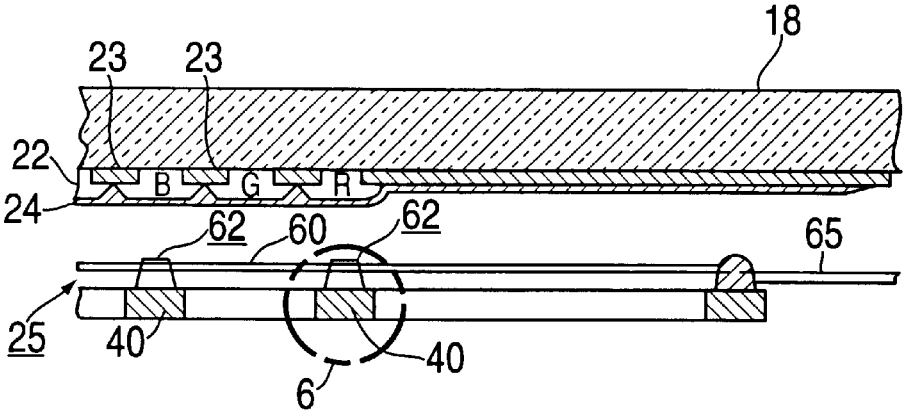
FIG. 5 is a view of the focus mask and the luminescent screen taken along lines 5—5 of FIG. 4.

With reference to FIGS. 4 and 5, a plurality of second metal wires 60, each having a diameter of about 0.025 mm (1 mil), are disposed substantially perpendicular to the first metal strands 40 and are spaced therefrom by an insulator 62 formed on the screen-facing side of each of the first metal strands 40. The second metal wires 60 form cross members that facilitate the application of a second anode, or focusing, potential to the mask 25. Suitable materials for the second metal wires include iron-nickel steel such as Invar and/or carbon steels such as HyMu80 wire (commercially available from Carpenter Technology, Reading, Pa.).

The vertical spacing, or pitch, between adjacent second metal wires 60 is about 0.33 mm (13 mils). The relatively thin second metal wires 60 provide the essential focusing function of the focus mask 25 without adversely affecting the electron beam transmission thereof. The focus mask 25, described herein, provides a mask transmission, at the center of the screen, of about 40–45%, and requires that the second anode, or focussing, voltage, $\Delta V$, applied to the second metal wires 60, differs from the voltage applied to the first metal strands 40 by less than about 1 kV, for a final anode or ultor voltage of about 30 kV.

Figure 6:
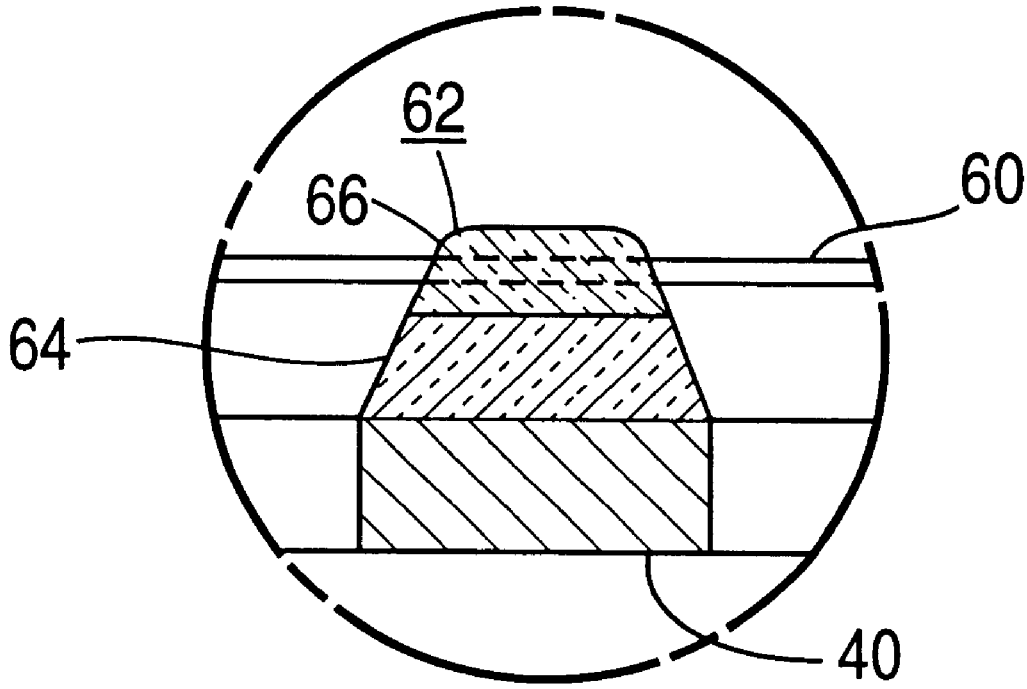
FIG. 6 is an enlarged view of another portion of the focus mask within the circle 6 of FIG. 5.

The insulators 62, shown in FIGS. 4–6, are disposed substantially continuously on the screen-facing side of each of the first metal strands 40. The second metal wires 60 are bonded to the insulators 62 to electrically isolate the second metal wires 60 from the first metal wires 60.

The insulators 62 are formed of a material that has a thermal expansion coefficient that is matched to the material of the focus mask 25. The material of the insulators should have a relatively low melting temperature so that it may flow, sinter, and adhere to both the first metal strands 40 and the second metal wires 60, within a temperature range of less than about 450° C. The insulator material should also have a dielectric breakdown strength in excess of about 4000 V/mm (100 V/mil).

Additionally, the insulator material should be stable at temperatures used for sealing the CRT faceplate panel 12 to the funnel (typically about 450° C. to about 500° C.), as well as have adequate mechanical strength and elastic modulus, and be low in outgassing during processing and operation for an extended period of time within the radiative environment of the CRT.

The bulk conductivity of insulator 62 should preferably range between about $10^{-10}$ (Ohm-cm)$^{-1}$ to $10^{-12}$(Oh-cm)$^{-1}$. The surface resistivity should be about $10^{12}$ ohm/square. The insulator leakage, the rate at which the charge is removed from the insulator by bulk or surface conductivity, minimally must be about 100 uA for bulk a conductivity charge removal for an applied focus mask delta-voltage of 500 V, and 80 uA for surface conductivity charge removal under the same focus mask delta-voltage, based upon a beam current condition of about 2.5 mA and an allowed insulator surface potential buildup of 40 V. The maximum allowable leakage is determined by the need for adequate voltage regulation by the delta-voltage supply and the allowable power allocated to such reduction by the power supply. In both cases, the particular mask design parameters must be taken into account.

An insulator material which has been found to work well is a lead-zinc-borosilicate glass, such as SCC-11, doped with $Fe_2O_3$ (5–10% by weight). SCC-11 is commercially available from SEM-COM, Toledo, Ohio.

What is claimed is:

1. A cathode-ray tube comprising a focus mask, wherein the focus mask has an aperture portion including a plurality of electrodes separated by an insulating material, wherein the insulating material consists essentially of a lead-zinc-borosilicate glass doped with $Fe_2O_3$, and wherein the insulating material is partially or slightly conductive to an extent sufficient to prevent an accumulation of a significant electrical charge.

2. The cathode ray tube of claim 1 in which the insulating material has a bulk conductivity value between $10^{-10}$ (ohm-cm)$^{-1}$ and $10^{-12}$ (ohm-cm)$^{-1}$.

3. A cathode-ray tube comprising a focus mask, wherein the focus mask has an aperture portion including a plurality of spaced-apart first conductive strands having an insulating material thereon, and a plurality of spaced-apart second conductive wires oriented substantially perpendicular to the plurality of spaced-apart first conductive strands, the plurality of spaced-apart second conductive wires being bonded to the insulating material, wherein the insulating material consists essentially of a lead-zinc-borosilicate glass doped with $Fe_2O_3$, wherein the insulating material is partially or slightly conductive to an extent sufficient to prevent an accumulation of a significant electrical charge.

4. The cathode ray tube of claim 3 in which the insulating material has a bulk conductivity value between $10^{-10}$ (ohm-cm)$^{-1}$ and $10^{-12}$ (ohm-cm)$^{-1}$.

5. The cathode-ray tube of claim 1, wherein the insulating material has a surface resistivity value of about $10^{12}$ ohms/square.

6. The cathode-ray tube of claim 3, wherein the insulating material has a surface resistivity value of about $10^{12}$ ohms/square.

* * * * *